US005635131A

United States Patent [19]

Klotz et al.

[11] Patent Number: 5,635,131

[45] Date of Patent: Jun. 3, 1997

[54] PALLADIUM WHITE GOLD ALLOY RING SETTINGS AND METHOD OF MAKING SAME

[75] Inventors: Frederick W. Klotz, Midlothian; Torrance D. Hoover, Richmond, both of Va.

[73] Assignee: Hoover & Strong, Inc., Richmond, Va.

[21] Appl. No.: 249,997

[22] Filed: May 27, 1994

[51] Int. Cl.[6] ..... C22C 5/02

[52] U.S. Cl. ..... 420/508; 148/678

[58] Field of Search ..... 420/508; 148/430, 148/678, 405; C22C 5/02

[56] References Cited

U.S. PATENT DOCUMENTS

| | | | |
|---|---|---|---|
| 1,340,451 | 5/1920 | Koch . | |
| 1,577,995 | 3/1926 | Wise . | |
| 1,987,451 | 1/1935 | Taylor . | |
| 2,050,077 | 8/1936 | Wise . | |
| 3,512,961 | 5/1970 | Sistare et al. . | |
| 4,557,895 | 12/1985 | Karamon et al. | 420/587 |
| 5,240,172 | 8/1993 | Steinke et al. | 420/508 |
| 5,340,529 | 8/1994 | De Witt et al. | 420/507 |
| 5,372,779 | 12/1994 | Reti | 420/508 |

FOREIGN PATENT DOCUMENTS

| | | | |
|---|---|---|---|
| 2453799 | 5/1976 | Germany | 420/508 |
| 2638837 | 3/1978 | Germany | 420/508 |
| 3641164 | 12/1986 | Germany | 420/508 |
| 61-067749 | 7/1986 | Japan | 420/508 |

OTHER PUBLICATIONS

W.S. Rapson and T. Groenewald, "Gold Usage", Academic Press, 1978, p. 48.

A.S. McDonald and G.H. Sistare, "The Metallurgy of Some Carat Gold Jewellery Alloys", Gold Bulletin, 1978, vol. 11, No. 4, pp. 128–131.

"Focus: The Nickel Controversy in Europe", MJSA Publication, vol. 4, No. 9, Sep. 1992.

"Nickel and Nickel Alloy Articles that come in contact with the skin", released by the Nickel Development Institute, Jul. 1992.

G. Normandeau, "White Golds: a Review of Commercial Material Characteristics and Alloy Design Alternatives", Gold Bulletin 1992, vol. 25 (3), pp. 94–103.

G.P. O'Connor, "Improvement of 18 Carat White Gold Alloys", Gold Bulletin, 1978, vol. 11 (2), pp. 35–39.

I.B. MacCormack and J.E. Bowers, "New White Gold Alloys", Gold Bulletin 1981, vol. 14(1), pp. 19–24.

C. Linden, "Some Aspects on Contact Allergy to Nickel", presented at the First Meeting of CEN/TC 283 precious Metals, Milan, 15–16 Jul. 1991.

D.P. Agarwal and G. Raykhtsaum, "Color Technology for Jewelry Alloy Applications", Proceedings of the Santa Fe Symposium on Jewelry Manufacturing Technology, 1988, MetChem Research Inc., 1989, pp. 229–243.

"Standard Test Method for Calculation of Color Differences from Instrumentally Measured Color Cordinates", ASTM Standard D2244–89, Annual Book of ASTM Standards, vol. 06.01.

J. J. Tuccillo and J.P. Nielsen, J. of Prosthetic Dentistry, vol. 25, pp. 629–637, 1971.

*Primary Examiner*—David A. Simmons
*Assistant Examiner*—Margery S. Phipps
*Attorney, Agent, or Firm*—Oliff & Berridge

[57] ABSTRACT

A ring setting is made from a nickel-free palladium white gold alloy that contains 7–12% by weight palladium; 50–65% by weight gold; 25–32% by weight silver; and 1–5% by weight zinc. Such ring settings are resistant to chemical or stress corrosion cracking.

16 Claims, No Drawings

PALLADIUM WHITE GOLD ALLOY RING SETTINGS AND METHOD OF MAKING SAME

BACKGROUND AND INTRODUCTION

The present invention relates to palladium white gold alloys for the preparation of ring settings resistant to chemical or stress corrosion cracking, and methods of using such palladium white gold alloy free of platinum and nickel to form ring settings.

Few things can be as upsetting to a jeweler as having a customer return a ring due to prong failure. In some cases, the stone has fallen out and has been lost. This causes additional problems such as replacement cost, possible damage to the jeweler's reputation, and the likelihood of liability. Also, many pieces have sentimental value which cannot be restored by even the most skilled craftsman.

Having been approached with such problems in the past, we have conducted studies and metallurgical examinations under extreme magnification to establish the cause of the problem. These studies have indicated that the underlying cause of prong failure has frequently been due to residual stress. This is an internal condition within the metal which, if not relieved, leads to cracking and eventual failure of the prong.

The nickel white gold alloys are the most popular choices for diamond settings in the United States. While they look attractive, they have a tendency to create problems which lead to prong failure. Nickel, while acting as a whitening agent for gold alloys, can make the metal brittle. This is due to the nickel being insoluble with gold. As it is melted, it mixes with other base metals to form nickel rich boundaries which become brittle when stressed. Consequently, the whiter the alloy the more prone to brittleness it will be.

Most cracks are not visible to the naked eye. They are intergranular fractures which form along the grain boundaries of the metal itself. While cracking through some of the grains has been infrequently observed, the majority of these faults occur along the grain boundaries. Once they are formed, these cracks act as a conduit for corrosive elements which hasten prong failure.

The possibility of prong failure caused by stress related problems can occur during soldering, cutting the seat, and manipulation of the prong. Until now, the only two choices for white settings have been relatively inexpensive 14K nickel white gold or stronger platinum settings at a much higher price. The alloy described below minimizes the risk of prong shear loss associated with 14K nickel white gold alloys and offers the security of platinum without the high cost. Palladium is more forgiving, more malleable, and is easier to work with than nickel white gold, and is much less expensive than platinum. In fact, a 14K palladium white gold setting costs just a fraction more than a nickel gold setting.

SUMMARY OF THE INVENTION

An object of the present invention is to provide ring settings with improved resistance to chemical or stress corrosion cracking.

Another object of the invention is to provide gold ring settings that avoid the shortcomings of ring settings made from prior gold alloys used for this purpose.

Still another object of the invention is to provide a ring setting made from a gold alloy that avoids prong failure while at the same time eliminating the need for platinum.

According to the present invention, this and other objects are achieved by a ring setting made from a palladium white gold alloy.

In a more detailed aspect, the invention features a ring setting made from a palladium white gold alloy that is essentially free of platinum and/or nickel. Still further, the palladium white gold alloy of this invention contains 7–12% by weight palladium; 50–65% by weight gold; 25–32% by weight silver; and 1–5% by weight zinc.

DETAILED DESCRIPTION OF THE INVENTION

In carrying out the present invention, the preferred alloy is a palladium alloy which contains 10% by weight palladium; 58.33% by weight gold; 29% by weight silver; and 2.67% by weight zinc. The alloys of the invention are essentially free of nickel and platinum.

The settings made from the present alloy can be provided in four prong, six prong, peg and also as solitaries.

It will be understood by persons skilled in the art that while the causes of the stress related problems discussed above are very subtle, most are within the control of the jeweler. The processes used in the assembly of a piece of jewelry can cause changes in the metal which will contribute to prong failure. Care must be taken when performing such operations as soldering the setting to the shank, cutting in the seat for the stone and bending the ends of the prongs over the stone.

As is known in the art, heating problems commonly develop during soldering when the setting is overheated or the piece is quenched. Subjecting a conventional setting to excessive temperature will result in cracking. Samples submitted for evaluation have frequently shown one side of a setting to be broken and brittle, while the opposite side remains very ductile and shows no signs of cracking. This would indicate uneven heating where the broken prongs were overheated while the uncracked prongs remained cooler. Quenching a piece which has been heated to a high temperature will result in a rapid cooling of the external material and a slower cooling of the core. This uneven thermal contraction can cause stress and even cracks in the setting. Excessive heat can also be generated while cutting the seat for the diamond into the prong. Naturally, reasonable precautions must be taken in the light of the knowledge of the art with all alloys in preparing settings. The alloys of the present invention are, however, greatly improved with respect to overcoming these problems than are the conventional alloys known in the art.

Bending or forming a setting causes a change in its grain structure. If overworked, this can lead to increased residual stress and eventual prong failure.

In order to prevent or minimize chances of breakage, care should be taken when performing soldering and setting operations in order to achieve uniform heating and cooling. Exposure to excessive heat may damage a prong or the setting. Even heating of the mounting is desirable, keeping in mind that the prongs which have less mass will heat up more rapidly than the shank. As is known in the art, overheating of the prongs can be avoided by directing the flame away from them. Overworking by annealing when needed and residual stress can be reduced by heat treating the mounting at 600° F. for a least 15 minutes, letting it air cool.

Thus, when soldering it is desirable that this be done in a furnace with a controlled atmosphere where even heating and cooling can be maintained. The result will be a clean mounting which is free of the problems associated with overheating. It will also yield a piece which is properly annealed and is very workable.

Further variations and modifications of the foregoing will be apparent to those skilled in the art and such variations and modifications are attended to be encompassed by the claims that are appended hereto.

What is claimed:

1. A ring setting made from a nickel-free palladium white gold alloy consisting of 7–10.5% by weight palladium; 50–65% by weight gold; 25–32% by weight silver; and 1–5% by weight zinc.

2. The ring setting according to claim 1, wherein said alloy consists of 10% by weight palladium; 58.33% by weight gold; 29% by weight silver; and 2.67% by weight zinc.

3. The ring setting according to claim 1, wherein said alloy contains 7–10% by weight palladium.

4. The ring setting according to claim 1, wherein said alloy is free of platinum.

5. A method of making a ring setting comprising forming the ring setting from a nickel-free palladium white gold alloy that consists of 7–10.5% by weight palladium; 50–65% by weight gold; 25–32% by weight silver; and 1–5% by weight zinc.

6. The method according to claim 5, wherein said alloy consists of 10% by weight palladium; 58.33% by weight gold; 29% by weight silver; and 2.67% by weight zinc.

7. The method according to claim 5, wherein said alloy contains 7–10% by weight palladium.

8. The method according to claim 5, wherein said alloy is free of platinum.

9. A ring setting made from a nickel-free palladium white gold allow, said ring setting including prongs consisting essentially of 7–12% by weight palladium; 50–65% by weight gold; 25–32% by weight silver; and 1–5% by weight zinc.

10. The ring setting of claim 9, wherein said alloy contains 7–10.5% by weight palladium.

11. The ring setting of claim 10, wherein said alloy contains 7–10% by weight palladium.

12. The ring setting of claim 9, wherein said alloy is free of platinum.

13. A method of making a ring setting comprising forming prongs of the ring setting from a nickel-free palladium white gold alloy that consists essentially of 7–12% by weight palladium; 50–65% by weight gold; 25–32% by weight silver; and 1–5% by weight zinc.

14. The method of claim 13, wherein said alloy contains 7–10.5% by weight palladium.

15. The method of claim 14, wherein said alloy contains 7–10% by weight palladium.

16. The method of claim 13, wherein said alloy is free of platinum.

* * * * *